US006472358B1

(12) United States Patent
Richter et al.

(10) Patent No.: US 6,472,358 B1
(45) Date of Patent: Oct. 29, 2002

(54) ACID SANITIZING AND CLEANING COMPOSITIONS CONTAINING PROTONATED CARBOXYLIC ACIDS

(75) Inventors: Francis Lawrence Richter, Lino Lakes, MN (US); Duane Joseph Reinhardt, Maplewood, MN (US); Richard R. Staub, Lakeville, MN (US); Teresa C. Podtburg, Waconia, MN (US)

(73) Assignee: EcoLab Inc., Mendota Heights, MN (US)

( * ) Notice: Subject to any disclaimer, the term of this patent is extended or adjusted under 35 U.S.C. 154(b) by 0 days.

(21) Appl. No.: 10/000,138

(22) Filed: Nov. 15, 2001

(51) Int. Cl.[7] ..... C11D 7/08

(52) U.S. Cl. ..... 510/234; 510/253; 510/258; 510/247; 424/718

(58) Field of Search ..... 510/234, 253, 510/258, 247; 424/718

(56) References Cited

U.S. PATENT DOCUMENTS

| | | | | | |
|---|---|---|---|---|---|
| 4,002,775 | A | | 1/1977 | Kabara | 426/532 |
| 4,343,798 | A | | 8/1982 | Fawzi | 424/240 |
| 4,404,040 | A | * | 9/1983 | Wang | 134/22.14 |
| 4,406,884 | A | | 9/1983 | Fawzi et al. | 424/81 |
| 4,822,513 | A | * | 4/1989 | Corby | 252/106 |
| 5,208,257 | A | | 5/1993 | Kabara | 514/552 |
| 5,308,868 | A | | 5/1994 | Kefford | 514/560 |
| 5,330,769 | A | * | 7/1994 | McKinzie et al. | 424/605 |
| 5,391,379 | A | * | 2/1995 | McKinzie et al. | 424/605 |
| 5,462,714 | A | | 10/1995 | Talwalker | 422/37 |
| 5,569,461 | A | | 10/1996 | Andrews | 424/405 |

* cited by examiner

*Primary Examiner*—Charles Boyer
(74) *Attorney, Agent, or Firm*—Vidas, Arrett & Steinkraus P.A.

(57) ABSTRACT

A sanitizing composition comprising at least one aliphatic short chain antimicrobially effective $C_5$ to $C_{14}$ fatty acid or mixture thereof, at least one carboxylic weak acid and a strong mineral acid which may be nitric or a mixture of nitric and phosphoric acids.

52 Claims, 1 Drawing Sheet

Foaming Evaluation

ACID SANITIZING AND CLEANING COMPOSITIONS CONTAINING PROTONATED CARBOXYLIC ACIDS

FIELD OF THE INVENTION

The present invention relates to acid sanitizing and/or cleaning compositions comprising antimicrobially effective $C_5$ to $C_4$ carboxylic acids. The present invention is directed to both concentrates and to water diluted use solutions.

BACKGROUND OF THE INVENTION

Periodic cleaning and sanitizing in food, drink, pharmaceutical, cosmetic and similar processing industries; in food preparation and service businesses; in health and day care facilities; and, in hospitality establishments are a necessary practice for product quality and public health. Residuals left on equipment surfaces or contaminants found in the process or service environment can harbor and nourish growth of subsequent processed product or critical contact surfaces. Protecting the consumer against potential health hazards associated with pathogens or toxins and maintaining the quality of the product or service requires routine cleaning of residuals from surfaces and effective sanitation to reduce microbial populations.

Visual inspection of the equipment cannot ensure that surfaces are clean or free of microorganisms. Antimicrobial treatments as well as cleaning treatments are therefore required for all critical surfaces in order to reduce microbial population to safe levels established by public health regulations. This process is generally referred to as sanitizing. The practice is of sanitation is particularly of concern in food process facilities wherein the cleaning treatment is followed by an antimicrobial treatment applied upon all critical surfaces and environmental surfaces to reduce the microbial population to safe levels established by ordinance. A sanitized surface is, as defined by the Environmental Protection Agency (EPA), a consequence of a process or program containing both an initial cleaning and a subsequent sanitizing treatment which must be separated by a potable water rinse. A sanitizing treatment applied to a cleaned food contact surface must result in a reduction in population of at least 99.999% (5 log) for specified microorganisms as defined by the "Germicidal and Detergent Sanitizing Action of Disinfectants", *Official Methods of Analysis of the Association of Official Analytical Chemists,* paragraph 960.09 and applicable sections, $15^{th}$ Edition, 1990 (EPA Guideline 91-1).

The antimicrobial efficacy of sanitizing treatments is significantly reduced if the surface is not absolutely free of soil and other contaminants prior to the sanitizing step. The presence of residual food soil and/or mineral deposits inhibit sanitizing treatments by acting as physical barriers which shield microorganisms lying within the organic or inorganic layer from the microbicide. Furthermore, chemical interactions between the microbicide and certain contaminants can disrupt the killing mechanism of the microbicide.

With the advent of automated clean-in-place and sanitize-in-place systems, the need for disassembly has been diminished, and cleaning and sanitizing have become much more effective. However, modern food industries still rely on sanitizers to compensate for design deficiencies or operational limitations in their cleaning programs and the probability of very small residual amounts of organic and inorganic soils and biofilms remaining on food contact surfaces after cleaning. In cooperation with these process changes and higher performance expectations, sanitizer treatments must also comply with the increasing demand for safer, less corrosive, more environmentally friendly compositions.

According to the U.S. Center for Disease Control and Prevention, food poisoning in calendar year 2000 resulted in 5000 deaths, 325,000 hospitalizations and 76,000,000 illnesses. The need exists for improved sanitizing treatments to destroy pathogens and food spoilage microorganisms resistant to conventional treatments within the food gathering, food processing, and food serving industries. A further complication is that the list of approved microbicidal agents has continued to decrease due to acute and chronic human toxicity of some microbicidal agents, and to their environmental persistence in water supplies.

Antimicrobially active acids have been used in sanitizing operations. For instance, U.S. Pat. No 404,040 describes a sanitizing composition comprising aliphatic, short chain fatty acids, a hydrotrope or solubilizer for the fatty acids, and a hydrotrope-compatible acid, and U.S. Pat. No. 5,330,769 describes fatty acid sanitizer concentrates and diluted final solutions which include individual amounts of germicidally effective fatty acid, hydrotrope, a strong acid group consisting of phosphoric acid and sulfuric acid or mixtures thereof sufficient to lower the pH of the final solutions to about 1–5, and a concentrate stabilizing weak acid component selected from the group consisting of propionic, butyric and valeric acids and mixtures thereof.

Protonated carboxylic acids offer broad spectrum antimicrobial activity against gram-positive and gram negative bacteria, persistent biocidal activity in the presence of organic and inorganic soils and residual biocidal and inhibitory activity. They combine both acid for mineral deposit control and sanitizer for antimicrobial effect into one treatment solution.

However, one problem associated with the use of protonated carboxylic acid sanitizers is poor use dilution phase stability, particularly at lower water temperatures of 40°–50° F. 50° F. Fatty monocarboxylic acids having alkyl chains containing 5 or more carbon atoms, are typically characterized as water insoluble and can oil out or precipitate from solution as a gelatinous flocculent. Solubility tends to decrease with decreasing water temperature and increasing ionic concentration. Furthermore, the oil or precipitate can affix to the very surfaces which the sanitizing solution is intended to sanitize, such as equipment surfaces, leading to a film formation on these surfaces over time. The fatty acid film deposited and left remaining on the equipment surface tends to have a higher pH than the sanitizing solution from which it came resulting in a significantly lowered biocidal efficacy, and, if mixed with food soil, may result in a film matrix which has the potential of harboring bacteria, an effect opposite to that desired.

One solution has been to use short chain, $C_1$–$C_4$ carboxylic or hydroxycarboxylic acids to solubilize and thus stabilize longer chain fatty acids in high actives composition concentrates. However, these short chain weak acids have been known to be less effective at normal use dilution concentrations than their longer chain counterparts, and extreme dilution of the concentrate in water leads to a decrease in the solvating effect resulting in a precipitate of the longer chain length fatty acids of $C_5$ or higher from solution. Furthermore, raising the concentration of the $C_1$–$C_4$ acids increases the cost of the sanitizing composition, and does not appear to result in a significant increase in dilution stability or to improved antimicrobial efficacy.

Organic hydrotropes or coupling agents, such as low molecular weight sulfonates, may be employed to increase the solubility and miscibility of the longer chain fatty acids with water and inorganic salts both in concentrated and in diluted use solutions. Again, the solubility appears to diminish at sustained lower water temperatures with the result being phase separation.

There remains a need in the art for an improved biocidal composition which utilizes a carboxylic fatty acid which has high antimicrobial efficacy, has good phase stability, exhibits low toxicity, and is not detrimental to the environment.

SUMMARY OF THE INVENTION

Surprisingly, the compositions of the present invention exhibit excellent phase stability both in concentrated form and in diluted use solutions, and in particular, they exhibit excellent phase stability in low temperature water diluted use solutions. Even more surprisingly, the stability is improved in the presence of nitric acid.

The sanitizing and/or cleaning compositions of the present invention, in both concentrated and in diluted use solutions, include an antimicrobially effective short chain fatty acid, a shorter chain weak carboxylic acid, and a strong mineral acid. The shorter chain weak carboxylic acid functions as a solvent.

The shorter chain weak carboxylic acid functions as a solvent for the antimicrobial short chain fatty acid. In concentrated form, the compositions also desirably contain an organic hydrotrope.

In some embodiments, the antimicrobially effective short chain fatty acid is a $C_5$ to $C_{14}$ fatty acid, and more suitably $C_6$ to $C_{10}$ fatty acid, or some mixture thereof, the shorter chain weak carboxylic acid is a $C_1$ to $C_4$ carboxylic acid, and the strong mineral acid is nitric, or a mixture of nitric and phosphoric acids.

In some embodiments wherein a hydrotrope is included in the composition, an anionic sulfonate hydrotrope is employed.

Additionally, the composition may optionally include at least one anionic and/or nonionic surfactant. In some embodiments, a nonionic surfactant is suitably employed to improve surface wetting, soil removal, and so forth. It may also function to improve the solubility of the fatty acids at use dilutions.

The antimicrobailly effective effective short chain fatty acid is useful from about 3 wt-% to about 12 wt-% of the concentrate, and more suitably from about 5 wt-% to about 10 wt-% of the concentrate. In one particular embodiment, the concentrate includes a blend of two fatty acids.

The weak carboxylic acid is useful from about 5 wt-% to about 50 wt-% of the concentrate, and more suitably from about 10 wt-% to about 40 wt-% of the concentrate. In one particular embodiment, the weak carboxylic acid component includes at least acetic acid. The weak carboxylic acid acts as a solvent for the antimicrobially active short chain fatty acid.

The strong mineral acid is useful from about 5 wt-% to about 50 wt-% of the concentrate, and more suitably about 15 wt-% to about 40 wt-% of the concentrate. In some embodiments, the strong mineral acid is nitric which is useful from about 5 wt-% to about 50 wt-% of the concentrate, and more suita concentrate. If phosphoric acid is employed, it is useful from 5 wt-% to about 40 wt-% of the concentrate, and more suitably about 10 wt-% to about 35 wt-% of the concentrate.

Surprisingly, the antimicrobially active short chain fatty acid is stable in nitric acid.

The compositions may further comprise optional ingredients including urea for stabilization of nitric acid, and a surfactant component. The surfactant component may include one or more surfactants. In some embodiments, an anionic or nonionic surfactant may be optionally added at a level of 0.1 wt-% to about 50 wt-% of the concentrate, more suitably about 0.25 wt-% to about 40 wt-% of the concentrate, even more suitably about 0.5 wt-% to about 40 wt-%, and most suitably about 1 wt-% to about 30 wt-%.

In some embodiments, an anionic hydrotrope is employed at a level of about 0.5 wt-% to about 50 wt-%, suitably about 1 wt-% to about 40 wt-% of the concentrate, and more suitably from about 5 wt-% to about 30 wt-% of the concentrate. In one embodiment, the anionic hydrotrope includes at least one alkylsulfonate.

The compositions may be diluted with water at any ratio whatsoever, but typically the ratio is between about 1:100 parts of the concentrate to water to about 1:1500 parts of the concentrate to water. This is referred to as a use dilution. A very typical use dilution is about 1 ounce of concentrate to about 6 gallons of water which is a ratio of about 1:768 parts of the concentrate to water.

The compositions of the present invention find utility as both sanitizing and disinfecting compositions as well as cleaning compositions, and are useful for both hard and soft surface sanitizing and disinfecting in farm operations, food processing operations, institutional food preparation and serving areas, health care and child care facilities as well as any other number of contact sensitive environments. The compositions exhibit high antimicrobial efficacy while having low toxicity, are not detrimental to the environment, and do not contaminate food stuffs.

The compositions also find utility for use as one-step cleaning/sanitizing compositions and disinfectants in which the composition cleans and sanitizes simultaneously.

DETAILED DESCRIPTIONS OF THE PREFERRED EMBODIMENTS

Figure 1:
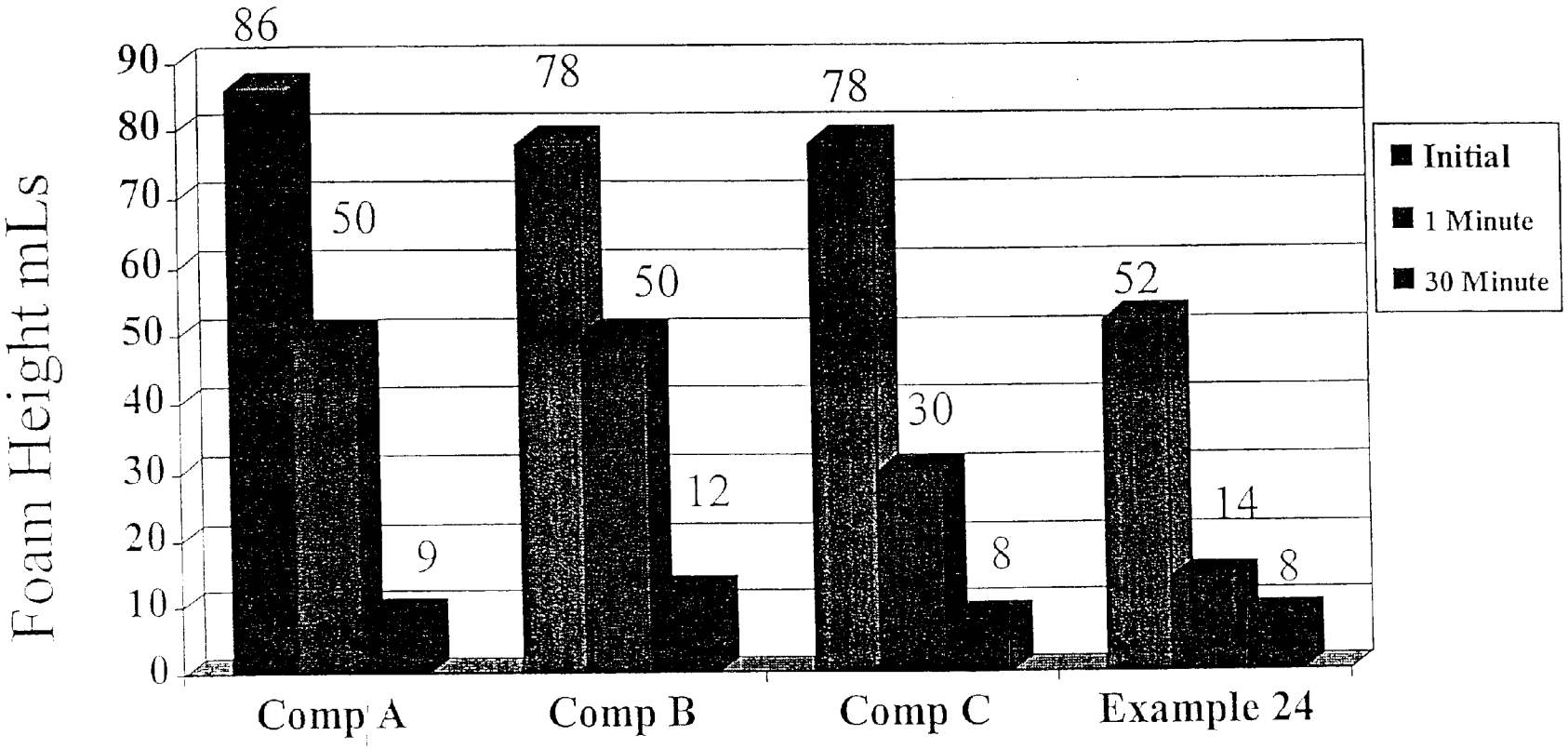
FIG. 1 is a bar graph illustrating results of a foaming evaluation conducted for example 24 which was compared to three commercially available sanitizing compositions.

While this invention may be embodied in many different forms, there are described in detail herein specific embodiments of the invention. This description is an exemplification of the principles of the invention and is not intended to limit the invention to the particular embodiments illustrated.

The antimicrobial agents useful herein include those referred to generally in the art as acid-anionics including carboxylic acids having biocidal activity when in protonated form. These antimicrobial agents are typically classified as having low toxicity and as being environmentally friendly.

The term "short chain fatty acids" as used herein refer to those acids generally having about 5 to 14 carbon atoms, suitably about 6 to 12 carbon atoms, more suitably from about 6 to 10 carbon atoms and most suitably about 7–10 carbon atoms. In some embodiments of the present invention, a blend of a $C_9$, fatty acid and a $C_{10}$ fatty acid or a blend of nonanoic and decanoic acids is employed.

The short chain fatty acids are useful from about 3 wt-% to about 12 wt-% of the concentrate and suitably about 5 wt-% to about 10 wt-% of the concentrate. In some embodiments of the present invention which employ a blend, nonanoic acid is utilized from about 2 wt-% to about 10 wt-% of the concentrate, suitably from about 3 wt-% to about 9 wt-%, and more suitably from about 4 wt-% to about 8 wt-% of the concentrate while decanoic acid is utilized from about 0.25 wt-% to about 5 wt-%, suitably from about 0.5 wt-% to about 4 wt-% and more suitably about 1 wt-% 3 wt-% of the concentrate. The present inventors have found that when employing such a blend of nonanoic and decanoic acids, the phase stability appears to be improved when employing more nonanoic acid, and less decanoic acid. It is surmised that the shorter chain of the nonanoic acid provides increased solubility in water over the decanoic acid, while the decanoic acid provides increased antimicrobial efficacy over the nonanoic acid. Blending the two has been found to be particularly advantageous.

The carboxylic weak acid is a $C_1$ to $C_4$ carboxylic acid. Examples of suitable carboxylic weak acids include, but are not limited to, acetic acid, hydroxyacetic acid, propionic acid, hydroxypropionic acid, alpha-ketopropionic acid, citric acid, butyric acid, valeric acid, succinic acid, tartaric acid, malic acid, fumaric acid, formic acid, adipic acid or mixtures thereof. Most suitably, the carboxylic weak acid solvent includes acetic acid. As noted above, the carboxylic weak acid acts as a solvent for the antimicrobially active short chain fatty acid. The carboxylic weak acid is useful from about 5 wt-% to about 50 wt-%, and suitably from about 10 wt-% to about 40 wt-% of the concentrate.

The strong acid component of the compositions is utilized to lower the pH in the final solutions to a desirable level of about 1–5, and preferably from about 2.5–4. The strong acid is suitably either nitric acid, or a mixture of nitric and phosphoric acids. Nitric acid is useful from about 5 wt-% to about 50 wt-% of the concentrate, and suitably from about 15 wt-% to about 40 wt-%. Phosphoric acid is useful from about 0 wt-% to about 40 wt-% of the concentrate and more suitably about 5 wt-% to about 35 wt-% of the concentrate. The fatty carboxylic acids of the present invention have been found to be particularly stable in the presence of nitric acid due to increased solubility in the presence of nitric acid. Nitric acid is also advantageously used in the compositions of the present invention because it is economical, and because it offers added protection to stainless steel by maintenance of the passive surface layer. Stainless steel is corrosion resistant due to an oxide film layer on the surface resulting from treatment with strong oxidizing agents such as nitric acid. Surfaces with this property are referred to as passive, or have a lower degree of chemical activity.

Another problem often associated with the use of acid sanitizers is corrosion of stainless steel surfaces associated with high mineral waters or softened waters containing chlorides which promote and accelerate corrosion of such surfaces. Strong oxidizing acids with oxidizing potential sufficient to passivate stainless are capable of reducing or eliminating such a problem.

A small amount of urea may be optionally employed in the compositions of the present invention. Organic degradation can occur in the presence of nitric acid by oxidation and nitration mechanisms due to the presence and oxidizing power of nitrogen dioxide ($NO_2$) and nitrogen tetroxide ($N_2O_4$), collectively referred to as nitrogen peroxide. Urea may be added to react with the nitrogen peroxide to reduce the nitrogen peroxide to nitrogen. Urea is useful in any amount effective to reduce the nitrogen peroxide to nitrogen, but is suitably used from about 0.05 wt-% to about 5 wt-%, and more suitably at a level of about 0.1 wt-% to about 1.0 wt-% of the concentrate.

Surfactants may also be optionally added to the compositions of the present invention for a variety of reasons including improved surface wetting by lowering the surface tension, improved soil or biofilm penetration, improved soil or biofilm penetration, removal and suspension of organic soils, enhancement of biocidal effect, characterization of foam profile, i.e. by the addition of low foaming and high foaming surfactants, and increasing the solubility of the fatty acid antimicrobial in water by acting as a hydrotrope or coupling agent for the fatty acid antimicrobial to mention a few. One skilled in the art will understand that some surfactants or mixtures of surfactants serve one or more of these purposes better than others. The surfactant or mixture of surfactants selected will therefore impart different beneficial characteristics to the compositions depending on the selection made. The surfactants may be selected depending on the expected use, method of application, concentration, temperature, foam control, soil type, and so forth. The selection will of course also depend on the end use application of the composition.

The surfactants useful herein include nonionic, anionic and cationic surfactants. Most suitably, the surfactants employed include water soluble or water dispersible anionic or nonionic surfactants, or some combination thereof.

Useful anionic surfactants include, but are not limited to, those compounds having an hydrophobic group of $C_{6-22}$ such as alkyl, alkylaryl, alkenyl, acyl, long chain hydroxyalkyl, alkoxylated derivatives thereof and so forth, and at least one water-solubilizing group of acid or salt form derived from sulfonic acid, sulfuric acid ester., phosphoric acid ester and carboxylic acid. The salt may be selected based on the specific formulation to which it is being added.

More suitably, the anionic surfactants useful herein include, but are not limited to, sulfonated anionics such as alkyl sulfonates or disulfonates, alkyl aryl sulfonates, alkyl naphthalene sulfonates, alkyl diphenyl oxide disulfonates, and so forth.

More particularly, the anionic surfactants more suitable for use herein include, but are not limited to, those anionic surfactants which are linear or branched $C_6$–$C_{14}$ alkylbenzene sulfonates, alkyl naphthalen sulfonates, long chain alkene sulfonates, long chain hydroxyalkane sulfonates, alkane sulfonates and the corresponding disulfonates including 1-octane sulfonate and 1,2-octane disulfonate, alkyl sulfates, alkyl poly(ethyleneoxy)ether sulfates and aromatic poly(ethyleneoxy) sulfates such as the sulfates or condensation products of ethylene oxide and nonyl phenol, having 1 to 6 oxyethylene groups per molecule, other sulfonated surfactants, and so forth.

Specific examples of anionic surfactants suitable for use herein include alkyl sulfonates such as 1-octane sulfonate commercially available from a variety of including Stepan Co. in Northfield, Ill. under the tradename of BIO-TERGE® PAS-8; PILOT® L-45, a $C_{11.5}$ alkylbenzene sulfonate (referred to as "LAS") from Pilot Chemical Co.; BIO-SOFT® S100 and S130, non-neutralized linear alkylbenzene sulfonic acids (referred to as "HLAS"), and S40, also an LAS, all from Stepan Company; DOWFAX® anionic alkylated diphenyl oxide disulfonate (ADPODS) surfactants available from Dow Chemical Co. including C-6 (45% and 78%); $C_2$–$C_{18}$ alkyl naphthalene sulfonates such as those available from PetroChemicals Co. under the tradename of PETRO® including the liquid PETRO® LBA; and so forth.

Examples of nonionic surfactants useful in the compositions of the present invention include, but are not limited to, the following classes:

1) polyoxypropylene-polyoxylethylene block polymers including those made from propoxylation and/or ethoxylation of an initiator hydrogen compound such as propylene glycol, ethylene glycol, glycerol, trimethylolpropane, ethylenediamine, and so forth such as those sold under the tradename of PLURONIC® AND TETRONIC® available from BASF Corp.;
2) condensation products of one mole of $C_8$ to $C_{18}$ branched or straight chain alkyl or dialkyl phenol with about 3 to about 50 moles of ethylene oxide such as those sold under the tradename of IGEPAL® available from Rhone-Poulenc and TRITON® available from Union Carbide.
3) condensation products of one mole of a saturated or unsaturated, branched or straight $C_6$ to $C_{24}$ alcohols with about 3 to about 50 moles of ethylene oxide such as those sold under the tradename of NEODOL® available from Shell Chemical Co. and ALFONIC® available from Condea Vista Co.;
4) condensation products of one mole of saturated or unsaturated, branched or straight chain $C_8$ to $C_{18}$ carboxylic acids with about 6 to about 50 moles of ethylene oxide such as those available under the tradename of NOPALCOL® from Henkel Corp. and LIPOPEG® from Lipo Chemicals, Inc.; and other alkanoic esters formed by condensation of carboxylic acids with glycerides, glycerin, and polyhydric alcohols;

5) surfactants produced by the sequential addition of ethylene oxide and propylene oxide to ethylene glycol, ethylenediamine which result in a hydrophile with hydrophobic blocks (i.e. propylene oxide) at the terminal ends (the hydrophilic and hydrophobic blocks are reversed) of each molecule weighing from about 1,000 to about 3,100 and the central hydrophile being about 10 wt-% to about 80 wt-% of the final molecule such as the PLURONIC® R surfactants and the TETRONIC® R (ethylene oxide and propylene oxide with ethylenediamine) surfactants also available from BASF Corp.; and 6) compounds from (1), (2), (3) and (4) modified by "capping" or "end blocking" the terminal hydroxy group or groups by reaction with small hydrophobic molecules such as propylene oxide, butylene oxide, benzyl choride, short chain fatty acids, alcohols or alkyl halides containing from 1 to about 5 carbon atoms, converting terminal hydroxy groups to chloride with thionyl chloride, and so forth leading to all-block, block-heteric, heteric-block or all-heteric nonionics.

More suitably, the nonionics useful herein include, but are not limited to, block copolymers of ethylene oxide and propylene oxide sequentially condensed upon initiators having difunctional or tetrafunctional reactive hydrogens and alcohol alkoxylates. Especially preferred surfactants for compositions of the present invention are mixtures of alkyl sulfonates and block copolymers of ethylene oxide and propylene oxide sequentially condensed onto an ethylenediamine initiator.

A blend of surfactants may be suitably employed in the present invention to arrive at the characteristics desirable for a particular application. For instance, some embodiments may include a surfactant for emulsification, a surfactant for soil removal, i.e. detersive surfactants, and so forth. Some embodiments may include the addition of a low foaming nonionic surfactants which have been found to be beneficial because they do not generate unwanted foam, do not interfere with antimicrobial activity, further solubilize otherwise insoluble or phase unstable fatty acids, and provide improved surface wetting a solid penetration properties. Therefore, a blend of surfactants may be desirable. This part of the composition may therefore be referred to as the surfactant component to accurately reflect the fact that a single surfactant may be utilized in the compositions of the present invention, or a blend including two or more surfactants may be utilized in the present invention. The surfactant component is generally useful from 0 wt-% to about 50 wt-% of the concentrate, suitably about 0.1 wt-% to about 50 wt-%, more suitably about 0.25 wt-% to about 45 wt-%, even more suitably about 0.5 wt-% to about 40 wt-%, and most suitably about 1 wt-% to about 30 wt-% of the concentrate.

As noted above, in some embodiments of the present invention, a coupler or hydrotrope will suitably be added to the compositions, particularly when supplied in concentrated form to solubilize the fatty acids in water. Those which have been found to be particularly effective for solubilizing the fatty acids of the present invention include, but are not limited to, the anionic sulfonate surfactants such as the alkali metal salts of $C_{6-18}$ alkyl sulfonates such as 1-octane sulfonate, the alkali metal aryl sulfonates, $C_{6-30}$ alkaryl sulfonates such as the sodium $C_{2-18}$ alkyl naphthalene sulfonates, sodium xylene sulfonates, sodium cumene sulfonates, alkyl benzene sulfonates, alkylated diphenyl oxide disulfonates, anionic mono and disubstituted alkyl ethoxylated phosphate esters, and so forth. Most suitably, the anionic hydrotrope includes 1-octane sulfonate. The organic hydrotrope is useful up to about 50 wt-% of the concentrate, suitably from about 0.5 wt-% to about 50 wt-%, more suitably from about 1 wt-% to about 40 wt-% , and most suitably from about 5 wt-% to about 30 wt-% of the concentrate.

Commercially available hydrotrope/couplers include, for example, DOWFAX® alkylated diphenyl oxide disulfonate surfactants; PETROL® alkyl naphthalene sulfonate surfactants; BIO-TERGE® PAS-8 octane sulfonate surfactants;and so forth. The proportion of the surfactant component which is made up of a hydrotrope depends upon various factors including the specific hydrotrope employed, and the specific fatty acid employed, for instance. The hydrotrope is generally useful from 0% to about 50 wt % of the concentrate and suitably about 1 to about 40 wt % of the concentrate, and more suitably about 5 wt-% to about 40 wt-% of the concentrate.

The addition of an anionic hydrotrope has been found useful for maintaining product stability, and for decreasing the chance of phase separation over time.

The lists of ingredients given herein are intended as exemplary lists and are by no means exhaustive of the ingredients useful herein. Such lists are not intended to limit the scope of the present invention.

Other ingredients may be optionally added to the compositions of the present invention to impart additional properties to the composition in amounts which do not detrimentally affect the desired properties. Such properties may include form, function, aesthetics, and so forth. Such ingredients include, but are not limited to, solvents, other surfactants, couplers, defoamers, chelating agents, dyes, fragrances, rheology modifiers, manufacturing process aids, corrosion inhibitors, preserving agents, buffers, tracers, inert fillers and solidifying agents other antimicrobials, and so forth.

The balance of the concentrates and/or diluted use solutions is typically water. A concentrate may or may not comprise any water. The concentrates may be diluted with any amount, but are typically diluted in the range of about 1:100 to about 1:1500 parts concentrate to water which are typical of normal use dilutions. For cleaning compositions, the compositions are typically more concentrated. For example, cleaning compositions may be diluted to ratios of about 1:100 to about 1:500, more suitably about 1:100 to about 1:300. For sanitizing compositions, the dilutions are typically greater than about 1:100 up to about 1:1500. A standard use dilution is about 1 ounce concentrate to about 6 gallons of water ($2.957\times10^{-2}$ liters to about 3.785 liters or about 29.57 ml to about 3785.41 ml). This ratio is approximately 1:768 parts concentrate to water. The compositions may also be diluted with solvents other than water. However, water is the most commonly used solvent for dilution.

The compositions of the present invention may be prepared in various forms in both ready-to-use, and in concentrated versions. As noted above, the concentrated compositions require no dilution, but are typically formulated in one of several ways.

Commonly, the compositions are prepared as liquid concentrates intended for further dilution just prior to use, or are prepared as ready-to-use compositions requiring no second dilution. They may also be prepared as dispensable and dissolvable solid powders, tablets, blocks, or other solid forms. Solid forms are often formulated with solidifying matrix forming chemicals well known to those of ordinary skill in the art. These examples are intended for illustrative purposes only. One of ordinary skill in the art understands that there are numerous modifications and other forms in which such compositions are available. Such modifications or changes in form can be made without departing from the scope of the present invention.

The compositions of the present invention have been found to be particularly suitable for use in cleaning and/or sanitizing operations because of their excellent stability at use dilutions, particularly in cooler water temperatures of 40–50° F. (4.4–10° C.). This property is particularly advantageous in food harvesting and food and beverage processing operations located in cold climate geographical regions where water temperatures are often cooler.

The present invention contemplates methods of using the composition for hard surface cleaning and/or sanitizing of in-place or clean-in-place (CIP)/SIP (steam-in-place) assemblies. The compositions may be introduced into a cleaning and/or sanitizing system either manually, or using an automatic metering and/or dispensing system. The compositions may be either pre- or post-diluted with water before or after addition to the system. This is usually accomplished at ambient temperatures. The composition is then circulated through the system, drained, and optionally, the system is rinsed one or more times with potable water. These CIP or SIP systems typically utilize low foaming compositions. However, high foaming compositions may be employed where foaming is not a concern and are contemplated as being within the scope of the present invention as described above. For example, high foaming sanitizers may be employed for sanitizing external surfaces of equipment, ceilings, walls, floors, and so forth, while low foaming compositions may be employed for cleaning the internal equipment systems such as piping systems, i.e. dairies, for example.

The present invention also contemplates methods of using the compositions as one-step cleaner/sanitizers and disinfectants in which one composition can both clean and sanitize a surface simultaneously. Typically the surface is characterized as a hard surface. Such surfaces include equipment involved in both food and beverage processing such as in dairy operations including pipelines and bulk tanks and breweries.

Various modifications can therefore be made to the present invention including modifications to the chemical formulation and to the physical form without departing from the scope of the present invention as described above.

The following non-limiting examples further illustrate the present invention.

EXAMPLES

Test Methods

1. Foaming Evaluation

Distilled water (300 mL) at a temperature of about 50–70° F. was poured into a 500 mL graduated cylinder. Powdered product (10 g) or liquid product (10 mL) was poured into the graduated cylinder which was then stoppered tightly. The cylinder was then inverted and returned to an upright position 10 times. The graduated cylinder was then allowed to sit and the water and form layers allowed to separate. The height of the foam layer in mL was determined at the highest and lowest points after the designated elapsed time. The average of the two readings was reported.

foam height=(mL of foam+liquid)−(mL of liquid)

2. Food Contact Surface Sanitizing Efficacy at 25° F.

Testing was conducted according to AOAC Germicidal and Detergent Sanitizing Action of Disinfectants 960.09, Official Methods of Analysis of the AOAC International, 16$^{th}$ Edition, 1995. Testing required EPA Pesticide Assessment Guidelines, Subdivision G 91-2(k)(2).

All of the examples tested were diluted at a ratio of 1 oz to 6 gallons concentrate to water (0.13%) using 500 ppm synthetic hard water (as CaCO). The hard water was prepared as follows:

Hard Water Preparation
500 ppm synthetic hard water (as $CaCO_3$) PREPARATION

| Solution A (mL) | Solution B (mL) | Total Volume (mL) | Final pH | Hardness Determination (ppm $CaCO_3$) |
|---|---|---|---|---|
| 5 | 4 | 1000 | 7.91 | 500 ppm |

Solution A:

31.74 g $MgCl_2$ (or equivalent of hydrates)+73.99 g $CaCl_2$ (or equivalent of hydrates) and diluted to 1 liter in boiled deionized water (heat sterilized)

Solution B:

56.03 g $NaHCO_3$ diluted to 1 liter in boiled deionized water (filter sterilized)

Two test systems were used for this study per USEPA Pesticide Assessment Guidelines Subdivision G, Series 91, Subseries 91-A, 91-2, (k)(2).

*Staphylococcus aureus* ATCC 6538
*Escherichia coli* ATCC 11229

$$\% \text{ Reduction} = \frac{\text{Inoculum Numbers} - \text{Survivor Numbers}}{\text{Inoculum Numbers}} \times 100$$

Each of the following compositions was prepared by admixing listed chemicals in sequential order, blending thoroughly by agitation and allowing each ingredient to completely disperse or dissolve into liquid mixture before addition of the next ingredient. The resultant compositions were clear and homogeneously uniform upon admixture of all listed ingredients. The concentrates were conditioned at 40° F. until visual phase instability was observed or after 4 days with no visual change in stability. Use dilutions were prepared similarly using 1 oz of the concentrate per 6 gallons water (0.13%). The use diluted compositions were also conditioned at 40° F. for 4 days and observed for physical instability. The examples are illustrative of the stability results obtainable with compositions of the present invention. Variation was exhibited in the range, however, particularly in relation to the amount of time a composition remained at low temperatures. Stabilities varied and lesser stabilities were obtained depending on conditions, time, and composition.

Examples 1–3

The following table 1 illustrates compositions of the present invention which utilize nitric acid as the strong acid and which contain no phosphoric acid.

TABLE 1

| | 1 | 2 | 3 |
|---|---|---|---|
| Glacial acetic acid | 15 | 15 | 15 |
| Nitric acid, 42° Be | 30 | 30 | 30 |
| 1-octane sulfonate, sodium, 40% active | 25 | 25 | 25 |
| Perlargonic acid ($C_9$) | 6 | 6 | 6 |
| Decanoic acid ($C_{10}$) | 1 | 1 | 1 |
| Urea | — | 0.1 | — |
| FD&C yellow #5, 0.10% (dye) | — | 0.44 | — |

TABLE 1-continued

| | 1 | 2 | 3 |
|---|---|---|---|
| DI water | 23.00 | 22.46 | 23 |
| Comment | CDS | dye not stable | CDS |

CDS = concentrate and dilution stable, no visible precipitate/floc, very minor surface

Examples 4–8

The following table 2 illustrates compositions of the present invention that utilize a blend of nitric acid and phosphoric acid and which contain no urea.

TABLE 2

| | 4 | 5 | 6 | 7 | 8 |
|---|---|---|---|---|---|
| Phosphoric acid, 75% | 15 | 15 | 10 | 10 | 15 |
| Nitric acid, 42 deg Be | 15 | 15 | 21 | 21 | 15 |
| Glacial acetic acid | 15 | 15 | 15 | 15 | 15 |
| 1-octane sulfonate, sodium, 40% active | 25 | 25 | 25 | 25 | 25 |
| Perlargonic acid ($C_9$) | 6 | 6 | 6 | 7 | 7 |
| Decanoic acid ($C_{10}$) | 1 | 1 | 1 | 1 | 1 |
| FD&C Yellow #5, 0.10% | 0.44 | — | — | — | — |
| DI water | 22.56 | 23 | 22 | 21 | 22 |
| Comments | dye not stable | CDS | CDS | CDS | CDS |

CDS = concentrate and dilution stable, no visible precipitate/floc, very minor surface

Examples 9–18

The following table 3 illustrates compositions of the present invention having a nitric acid/phosphoric acid blend and containing varying amounts of urea.

TABLE 3

| | 9 | 10 | 11 | 12 | 13 | 14 | 15 | 16 | 17 | 18 |
|---|---|---|---|---|---|---|---|---|---|---|
| Phosphoric acid, 75% | 10 | 10 | 10 | 10 | 10 | 10 | 10 | 10 | 10 | 10 |
| Nitric acid, 42 deg Be | 21 | 21 | 21 | 21 | 21 | 21 | 21 | 21 | 21 | 21 |
| Glacial acetic acid | 15 | 15 | 15 | 15 | 15 | 15 | 15 | 20 | 20 | 20 |
| 1-octane sulfonate, sodium, 40% active | 25 | 25 | 25 | 25 | 25 | 30 | 25 | 25 | 30 | 30 |
| Perlargonic acid ($C_9$) | 7 | 7 | 7 | 7 | 7 | 7 | 6 | 7 | 7 | 6 |
| Decanoic acid ($C_{10}$) | 1 | 1 | 1 | 1 | 1 | 1 | 1 | 1 | 1 | 1 |
| Urea | 0.10 | 0.50 | 1.00 | 5.00 | 0.25 | 0.5 | 0.5 | 0.5 | 0.5 | 0.5 |
| DI water | 20.9 | 20.5 | 20.0 | 16.0 | 20.75 | 15.50 | 21.50 | 15.50 | 10.50 | 11.50 |
| Comments | CDS | CDS | CDS | CDS | CDS | CDS | CDS | CDS | CDS | CDS |

CDS = concentrate and dilution stable, no visible precipitate/floc, very minor surface

Examples 19–28

The following tables 4–8 illustrate compositions of the present invention employing various surfactant blends.

TABLE 4

| | 19 | 20 | 21 | 22 | 23 | 24 | 25 |
|---|---|---|---|---|---|---|---|
| Phosphoric acid, 75% | 10 | 10 | 10 | 10 | 10 | 10 | 10 |
| Nitric acid, 42 deg Be | 21 | 21 | 21 | 21 | 21 | 21 | 21 |
| Glacial acetic acid | 15 | 15 | 15 | 15 | 15 | 15 | 15 |
| 1-octane sulfonate, sodium, 40% active | 25 | 25 | 25 | 25 | 25 | 25 | 25 |
| PLURAFAC ® RA-40 | 1.00 | — | — | — | — | — | — |
| TETRONIC ® 1307 | — | 2.00 | — | — | — | — | — |
| TETRONIC ® 1107 | — | — | 2.00 | 1.00 | 0.50 | — | — |
| TETRONIC ® 908 | — | — | — | — | — | 0.50 | 0.65 |
| Perlargonic acid ($C_9$) | 7 | 7 | 7 | 7 | 7 | 7 | 7 |
| Decanoic acid ($C_{10}$) | 1 | 1 | 1 | 1 | 1 | 1 | 1 |
| Urea | 0.5 | 0.5 | 0.5 | 0.5 | 0.5 | 0.5 | 0.5 |
| DI water | 19.50 | 18.50 | 18.50 | 19.50 | 20.00 | 20.00 | 19.85 |
| Comments | ECDS | ECDS | ECDS | ECDS | ECDS | ECDS | ECDS |

ECDS = excellent concentrate and dilution stability, no visible precipitate/floc, no visible surface oiling at 40° F.

PLURAFAC® RA-40 is an alcohol ethoxylate.

TETRONIC® 908, 1107 AND 1307 are all nonionic surfactants block copolymer adducts of ethylene oxide and propylene oxide to ethylenediamine.

Example 24 and Comparative Examples A–C

Comparative Examples A–C are representative of commercially available sanitizing compositions which are standards in the industry.

TABLE 5

| Comparative A (wt-%) | Comparative B | Comparative C |
|---|---|---|
| 30% phosphoric acid | 16% soft water | 11% soft water |
| 21.99956% citric acid, (50% active) | 38% phosphoric acid, (75% active) | 35% phosphoric acid (75% active) |
| 9% citric acid, anhydrous | 10% propionic acid | 8% lactic acid, food grade (88% active) |
| 30% 1-octane sulfonate, sodium (40% active) | 3% perlargonic acid | 34% sodium linear alkyl naphthalene sulfonate |
| 6% octanoic acid | 3% decanoic acid | 9% octanoic acid |
| 2% decanoic acid | 30% 1-octane sulfonate, sodium (40% active) | 3% decanoic acid |
| q.s. isopropyl alcohol | q.s. FD&C yellow #5 | |
| q.s. FD&C yellow #5 | | |

A foaming evaluation was conducted according to Test Method #1. FIG. 1 is a bar graph showing the results of the foaming evaluation. As can be seen from the graph, example 24 exhibited a lower foam height than comparatives A–C which are standards in the industry.

Formula 24 was further tested for food contact surface sanitizing efficacy at 25° F. as described in Test Method #2 above. The following results were obtained.

TABLE 6

Efficacy Test Results
*Staphylococcus aureus* ATCC 6538

| Test Substance (Batch Number) | Average CFU/mL of Test Survivors | Percent Reduction |
|---|---|---|
| Formula 24 | $3.0 \times 10^1$ | >99.999 |
| (Batch 1) | $1.8 \times 10^2$ | >99.999 |
| Formula 24 | $7.5 \times 10^1$ | >99.999 |
| (Batch 2) | $7.5 \times 10^1$ | >99.999 |

TABLE 6-continued

Efficacy Test Results
*Staphylococcus aureus* ATCC 6538

| Test Substance (Batch Number) | Average CFU/mL of Test Survivors | Percent Reduction |
|---|---|---|
| Formula 24 | $5.5 \times 10^1$ | >99.999 |
| (Batch 3) | $2.8 \times 10^2$ | >99.999 |

TABLE 7

Efficacy Test Results
*Escherichia coli* ATCC 11229

| Test Substance (Batch Number) | Average CFU/mL of Test Survivors | Percent Reduction |
|---|---|---|
| Formula 24 | $7.5 \times 10^1$ | >99.999 |
| (Batch 1) | <10 | >99.999 |
| Formula 24 | <10 | >99.999 |
| (Batch 2) | <10 | >99.999 |
| Formula 24 | <10 | >99.999 |
| (Batch 3) | <10 | >99.999 |

As can be seen from tables 6 and 7, formula 24 exhibited a 99.999% reduction of *S. aureus* and *E. coli*. Example 24 therefore meets the efficacy requirements of a food contact surface sanitizer.

TABLE 8

| | 26 | 27 | 28 |
|---|---|---|---|
| Phosphoric acid, 75% | 10 | 10 | 10 |
| Nitric acid, 42 deg Be | 21 | 21 | 21 |
| Glacial acetic acid | 15 | 15 | 15 |
| 1-octane sulfonate, sodium, 40% active | 25 | 25 | 25 |
| DOWFAX ® C-6 acid, 45% | — | — | — |
| DOWFAX ® C-6 acid, 78% | — | — | — |
| PETRO ® LBA liquid, 50% | — | — | — |
| TETRONIC ® 908 | 1.00 | 1.50 | 2.00 |
| Perlargonic acid ($C_9$) | 7 | 7 | 7 |
| Decanoic acid ($C_{10}$) | 1 | 1 | 1 |
| Urea | 0.5 | 0.5 | 0.5 |

TABLE 8-continued

| | 26 | 27 | 28 |
|---|---|---|---|
| DI water | 19.50 | 19.00 | 18.50 |
| Comments | ECDS | ECDS | ECDS |

DOWFAX ® C-6 is a sodium hexyl diphenyloxide disulfonate
PETRO LBA is a sodium alky naphthalene sulfonate
TETRONIC ® 908 is a block copolymer adduct of ethylene oxide and propylene oxide to ethylenediamine.

TABLE 1

| | Cleaning Compositions | |
|---|---|---|
| | Example 29 | Example 30 |
| Phosphoric acid, 75% | 20.0 | 20.0 |
| Nitric Acid, 42 Be | 21.0 | 21.0 |
| Glacial Acetic Acid | 15.0 | 15.0 |
| 1-octane sulfonate | 10.0 | 20.0 |
| TETRONIC ® 908 | 0.5 | 1.50 |
| Perlargonic acid | 1.0 | 3.4 |
| Decanoic acid | 0.15 | 0.5 |
| Urea | 0.5 | 0.5 |
| DI water | 26.85 | 18.10 |

The above compositions are illustrative of compositions of the present invention which are useful as cleaning compositions, i.e. one-step cleaning compositions. Example 29 is intended for 1% dilution (1:100 concentrate to water) and example 29 is intended for 0.3% (1:333 concentrate to water) dilution.

What is claimed is:

1. A sanitizing and/or cleaning composition comprising:

a) about 3 wt-% to about 12 wt-% of the composition of at least one aliphatic short chain antimicrobially effective $C_5$ to $C_{14}$ fatty acid or mixture thereof;

b) about 5 wt-% to about 50 wt-% of the composition of at least one weak $C_1$ to $C_4$ carboxylic acid; and c) about 5 wt-% to about 50 wt-% of the composition of a strong acid which is nitric acid or a mixture of nitric and phosphoric acids.

2. The composition of claim 1 wherein said at least one weak carboxylic acid is acetic acid, hydroxyacetic acid, propionic acid, hydroxypropionic acid, alpha-ketopropionic acid, citric acid, butyric acid, valeric acid, succinic acid, tartaric acid, malic acid, fumaric acid, adipic acid, formic acid, or mixture thereof.

3. The composition of claim 1 wherein said at least one aliphatic short chain antimicrobially effective fatty acid is a $C_6$ to $C_{10}$ fatty acid.

4. The composition of claim 1 wherein said at least one weak carboxylic acid is acetic acid.

5. The composition of claim 1 wherein said aliphatic short chain fatty acid is decanoic, nonanoic or a mixture thereof.

6. The composition of claim 1 wherein said aliphatic short chain fatty acid is nonanoic acid.

7. The composition of claim 1 wherein said aliphatic short chain fatty acid is present at a concentration of about 5 wt-% to about 10 wt-% of the composition.

8. The composition of claim 5 wherein said mixture comprises about 0.25 to about 5 wt-% of the composition decanoic acid and about 2 to about 10 wt-% of the composition nonanoic acid.

9. The composition of claim 5 wherein said mixture comprises about 0.5 to about 4 wt-% of the composition decanoic acid and about 3 to about 9 wt-% of the composition nonanoic acid.

10. The composition of claim 5 wherein said mixture comprises about 1 to about 3 wt-% of the composition decanoic acid and about 4 to about 8 wt-% of the composition nonanoic acid.

11. The composition of claim 5 wherein said mixture comprises about 1 wt-% of the composition decanoic and about 6 to about 7 wt-% of the composition nonanoic acid.

12. The composition of claim 1 wherein said at least one weak carboxylic acid is present at a concentration of about 10 wt-% to about 40 wt-% of the composition.

13. The composition of claim 1 wherein said at least one weak carboxylic acid is acetic acid.

14. The composition of claim 1 wherein said phosphoric acid is present at a concentration of about 5 wt-% to about 40 wt-% of the composition.

15. The composition of claim 1 wherein said phosphoric acid is present at a concentration of about 10 wt-% to about 35 wt-% of the composition.

16. The composition of claim 1 wherein said nitric acid is present at a concentration of about 5 wt-% to about 50 wt-% of the composition.

17. The composition of claim 1 wherein said nitric acid is present at a concentration of about 15 wt-% to about 40 wt-% of the composition.

18. The composition of claim 1 further comprising an effective amount of urea to reduce nitrogen peroxide to nitrogen.

19. The composition of claim 18 wherein said effective amount of urea is about 0.05 wt-% to about 5 wt-% of the composition.

20. The composition of claim 18 wherein said effective amount of urea is about 0.5 wt-% of the composition.

21. The composition of claim 1 further comprising at least one surfactant.

22. The composition of claim 21 wherein said at least one surfactant is nonionic.

23. The composition of claim 22 wherein said at least one surfactant is a tetrafunctional block copolymer derived from the addition of ethylene oxide and propylene oxide to ethylenediamine.

24. The composition of claim 21 wherein said surfactant is present at a concentration of 0.1 wt-% to about 50 wt-% of the composition.

25. The composition of claim 1 further comprising at least one organic hydrotrope.

26. The composition of claim 25 wherein said organic hydrotrope is an anionic sulfonate or corresponding disulfonate.

27. The composition of claim 26 wherein said organic hydrotrope is an alkyl sulfonate, an aryl sulfonate, a $C_{6-30}$ alkaryl sulfonate or a corresponding disulfonate, an alkylated diphenyl oxide disulfonate, or an anionic mono or disubstituted alkyl ethoxylated phosphate ester, or a mixture thereof.

28. The composition of claim 27 wherein said organic hydrotrope is 1-octane sulfonate.

29. The composition of claim 25 wherein said organic hydrotrope is present at a concentration of about 0.5 wt-% to about 50 wt-% of the composition.

30. The composition of claim 1 further comprising water.

31. The composition of claim 30 wherein said concentrate is diluted with water at a ratio of 1:100 to about 1:1500 parts concentrate to water.

32. The composition of claim 30 wherein said concentrate is diluted at a ration of about 1:768 parts concentrate to water.

33. A method of one-step cleaning and sanitizing a surface comprising the step of contacting said surface with a composition as in claim 1.

34. The method of claim 33 further comprising the step of diluting said composition with water at a ration of about 1:100 to about 1:1500 of the composition to water.

35. A clean-in-place method of cleaning a beverage or food processing unit including conduits, surfaces and containers, comprising the steps of:

a) providing the composition of claim 1; and b) contacting conduits, surfaces and containers in said beverage processing unit, c) removing said composition from said unit for the purpose of reinitiating processing.

36. The method of claim 35 further comprising the step of diluting said composition with water at a ratio of about 1:100 to about 1:1500 of the composition to water.

37. A dilutable acid sanitizing and/or cleaning concentrate composition comprising about 0.25 wt-% to about 10 wt-% of the concentrate of at least one $C_6$ to $C_{10}$ fatty acid or mixture thereof;

about 5 wt-% to about 50 wt-% of the concentrate of a $C_1$ to $C_4$ weak carboxylic acid;

about 0 wt-% to about 40 wt-% of the concentrate phosphoric acid;

about 5 wt-% to about 50 wt-% of the concentrate nitric acid; and about 0.05 wt-% to about 5 wt-% of the concentrate urea; with the proviso that the concentration of nitric acid and phosphoric acid does not exceed about 50 wt-% of the concentrate.

38. The composition of claim 37 wherein said phosphoric acid is present at a concentration of about 5 wt-% to about 40 wt-% of the concentrate.

39. The composition of claim 37 further comprising at least one surfactant at a concentration of about 0.1 wt-% to about 50 wt-% of the concentrate.

40. The composition of claim 37 further comprising water.

41. A cleaning composition comprising:

a) about 0.5 wt-% to about 10 wt-% of at least one short chain fatty acid;

b) 0 wt-% to about 40 wt-% phosphoric acid;

c) about 5 wt-% to about 50 wt-% nitric acid;

d) about 0.5 wt-% to about 50 wt-% of at least one surfactant; and e) about 5 wt-% to about 50 wt-% of the concentrate of a $C_1$ to $C_4$ weak carboxylic acid;

with the proviso that the concentration of nitric acid and phosphoric acid does not exceed about 50 wt-% of the concentrate.

42. The composition of claim 41 wherein said composition comprises about 5 wt-% to about 40 wt-% of said at least one surfactant.

43. The composition of claim 42 wherein said at least one surfactant is anionic.

44. The composition of claim 43 wherein said at least one surfactant is an alkyl sulfonate, an aryl sulfonate, a $C_{6-30}$ alkaryl sulfonate or a corresponding disulfonate, an alkylated diphenyl oxide disulfonate, or an anionic mono or disubstituted alkyl ethoxylated phosphate ester, or a mixture thereof.

45. The composition of claim 44 wherein said at least one surfactant is a 1-octane sulfonate.

46. The composition of claim 41 wherein said at least one surfactant is nonionic.

47. The composition of claim 46 wherein said at least one surfactant is a tetrafunctional block copolymer derived from the addition of ethylene oxide and propylene oxide to ethylenediamine.

48. The composition of claim 46 wherein said at least one surfactant is present at a concentration of about 0.25 wt-% to about 10 wt-%.

49. The composition of claim 41 wherein said at least one fatty acid is present at a concentration of about 1 wt-% to about 5 wt-%.

50. The composition of claim 41 wherein said at least one fatty acid comprises about 0.1 wt-% to about 5 wt-% decanoic acid and about 0.5 wt-% to about 10 wt-% nonanoic acid.

51. The composition of claim 41 wherein said at least one fatty acid comprises about 0.1 wt-% to about 1 wt-% decanoic acid and about 1 wt-% to about 5 wt-% nonanoic acid.

52. A sanitizing and/or cleaning composition comprising:

a) 1 part of at least one aliphatic short chain antimicrobially effective $C_5$ to $C_{14}$ fatty acid or mixture thereof;

b) about 1.7 to about 4.2 parts of at least one weak $C_1$ to $C_4$ carboxylic acid; and c) about 1.7 to about 4.2 parts of a strong acid which is nitric acid or a mixture of nitric and phosphoric acids.

* * * * *